US005388775A

United States Patent [19]

Duguay

[11] Patent Number: 5,388,775

[45] Date of Patent: Feb. 14, 1995

[54] METHOD AND MEANS FOR PREVENTING THE LIFTING OF THE LEADING EDGE OF A WEB ON A ROTATING WEB ROLL DUE TO WINDAGE

[75] Inventor: Robert Duguay, Brockton, Mass.

[73] Assignee: Butler Automatic, Inc., Canton, Mass.

[21] Appl. No.: 127,647

[22] Filed: Sep. 28, 1993

Related U.S. Application Data

[62] Division of Ser. No. 940,517, Sep. 4, 1992, Pat. No. 5,301,891.

[51] Int. Cl.[6] ..... B65H 19/18; B65H 75/00

[52] U.S. Cl. ..... 242/160.1; 242/556

[58] Field of Search ..... 242/58.5, 160.1, 556, 242/556.1; 206/389, 411

[56] References Cited

U.S. PATENT DOCUMENTS

| | | | |
|---|---|---|---|
| 1,465,786 | 8/1923 | Wheildon | 242/58.5 |
| 2,263,023 | 11/1941 | Windolph | 206/389 X |
| 2,454,864 | 11/1948 | Dexter | 206/389 |
| 3,190,443 | 6/1965 | Kingsley | 206/389 |
| 3,592,340 | 7/1971 | Hoey | 206/389 |
| 3,654,035 | 4/1972 | Takimoto . | |
| 3,960,272 | 6/1976 | Hartbauer et al. | 206/389 |
| 4,612,232 | 9/1986 | Obara et al. | 206/389 X |
| 4,905,924 | 3/1990 | Moore . | |

FOREIGN PATENT DOCUMENTS

| | | | |
|---|---|---|---|
| 659615 | 10/1951 | United Kingdom | 206/411 |
| 8002391 | 11/1980 | WIPO | 206/411 |

*Primary Examiner*—John M. Jillions
*Attorney, Agent, or Firm*—Waddey & Patterson

[57] ABSTRACT

The leading end of a web on a roll of web convolutions is prepared for a splice by releasably securing that web end to the adjacent underlying web convolution on the roll and then adhering to that convolution just ahead of the web end a spoiler strip having a lengthwise boundary line which extends the length of the strip. A surface portion of the strip on one side of that boundary line is coated with an adhesive so that the adherent portion of the strip is speed in front of and substantially parallel to the web end whereby when the roll is rotated, the spoiler strip deflects the on-coming air stream away from the web end, yet permits the web end to be pulled away from the roll when being spliced to another web. Different spoiler strip constructions are also disclosed.

10 Claims, 1 Drawing Sheet

METHOD AND MEANS FOR PREVENTING THE LIFTING OF THE LEADING EDGE OF A WEB ON A ROTATING WEB ROLL DUE TO WINDAGE

This is a divisional application of U.S. patent application Ser. No. 940,517, filed Sep. 4, 1992, now U.S. Pat. No. 5,301,891, for "Method and Means for Preventing the Lifting of the Leading Edge of a Web on a Rotating Web Roll Due to Windage".

FIELD OF THE INVENTION

This invention relates to the splicing of webs from a succession of web rolls while the webs are in motion so web can proceed uninterruptedly to a web consuming machine, such as a printing press. It relates more particularly to a method and means for preparing the leading end of the web on a ready roll in preparation for the splice.

BACKGROUND OF THE INVENTION

The providing of an uninterrupted supply of web is important in many industries, particularly in the printing industry. Today's high speed printing presses print on web, i.e., paper, cloth, etc., drawn from a roll rotatably supported by a roll stand located upstream from the press. In order to avoid having to shut down the press each time a web roll expires, a splicing mechanism is invariably incorporated into the roll stand to enable the trailing end of the expiring web to be spliced to the leading end of the web on a new roll.

Modern day presses can turn at very high speeds and thus they consume web at a high rate, e.g., approaching 3000 feet per minute (FPM). Consequently, in order for the printing operation to proceed with maximum efficiency, it is critical that each splice be made and be essentially perfect to avoid large tension upsets and downstream web jams which can cause a web break, necessitating stoppage of the press.

In speed match splicers which splice at line speed or at some greater or lesser speed, prior to each splicing operation, the leading end of the web on the ready roll must be prepared for the splice. Such preparation involves trimming that leading end so that it is straight, V-shaped or W-shaped depending upon the size of the ready roll, and temporarily "tacking" that end to the underlying web convolution on the ready roll by means of short adhesive tabs spaced along the leading end of the web and oriented perpendicular thereto. The tacking of the leading end to the remainder of the roll can also be accomplished by double face low tack adhesive strips or low tack adhesive spots applied to the undersurface of the leading edge margin of the web.

The splice preparation procedure also invariably involves the application of a straight, V-shaped or W-shaped splicing tape to the leading edge margin of the web on the ready roll. That adhesive presents a sticky or tacky surface to the running web. In lieu of tape, adhesive lines or spots may also be used for this purpose.

In the typical speed match splicer, the actual splice is effected by pressing the running web against the surface of the ready roll after the running web and the ready roll surface have been speed matched. The two webs become pasted together or spliced as soon as the splicing tape or adhesive area on the ready roll is rotated into engagement with the running web. Immediately thereafter, a knife is actuated to sever the running web just behind the splice, thereby separating the running web from its nearly empty roll core, leaving the ready roll to supply the continuing needs of the web consuming machine.

Conventional speed match splicers operate reasonably well up to speeds of 2000 FPM. However, as the web speeds approach 3000 FPM, certain problems manifest themselves which are traceable directly or indirectly to the fact that when the ready roll is accerelated up to the speed of the running web prior to making a splice, windage at the surface of the roll can lift the leading end of the ready web, resulting in a splice to the running web that is less than perfect. In those cases in which the leading end of the ready web is held to the web roll by adhesive tabs, the force of the air stream tends to lift the web end segments between the tabs causing wrinkles and, in extreme cases, even tears in the web adjacent to those tabs. In those instances in which the leading end of the ready web is tacked to the web roll using a low tack adhesive, the entire web edge can curl or lift up away from the web ready roll. In both cases, when the paste is made between the leading end of the ready web and the running web, the splice area may contain wrinkles, bumps and gaps or other defects which can cause tension upsets and problems in downstream printing couples.

To avoid these problems, some attempts have been made to prevent the lifting of the leading end of the web on the ready roll during splicing. Usually, these attempts have involved the employment of higher tack adhesives to adhere the web end to the roll. However, such attempts run the risk that when the running web is pressed against the ready web roll at the time of splicing, the leading end of the web will not be pulled away from the ready web roll, resulting in a missed splice and the consequences thereof in terms of web wastage and downtime.

Other attempts to avoid the consequences of windage on the ready roll have involved the use of complicated segmented splicing tapes to hold down the leading end of the ready web in preparation for a splice. A typical tape of this type is disclosed in U.S. Pat. No. 4,905,924. The tape consists of several sections separated by score lines. The underside of this tape carries an adhesive layer which is adhered both to the leading end of the ready web and to the underlying roll convolution. The score lines enable tape backing bands to be peeled away to expose underlying adhesive stripes for making the splice but leave an intervening non-adhesive bridge area for protecting the stripes against contact with the splicing apparatus. That tape is relatively expensive to make and requires the manual peeling away of the backing sections to make the tape operative. Also, when the paste to the running web is made, the splice area may contain ripples due to the peeling away of the backing sections to expose the adhesive stripes to the running web. As a result of the aforesaid problems, to applicant's knowledge, such tapes are not used to any great extent in actual practice.

SUMMARY OF THE INVENTION

Accordingly, the present invention aims to provide an improved method of preparing the leading end of the web on a ready roll for splicing to a running web.

Another object of the invention is to provide a method of preventing the lifting of the leading end of a web on a rotating roll due to windage.

Still another object to the invention is to provide apparatus for preventing the lifting of the leading end of a web on a rotating ready roll due to the effects of windage on the roll.

A further object of the invention is to provide apparatus for preparing the leading end of the web on a ready roll in preparation for splicing to a running web.

Yet another object of the invention is to provide apparatus of this general type which does not add appreciably to the trouble and expense of preparing the leading end of a web on a ready roll prior to splicing that web to a running web.

Other objects will, in part, be obvious and will, in part, appear hereinafter. The invention accordingly comprises the several steps and the relation of one or more of such steps with respect with each of the others, and the apparatus embodying the features of construction, combination of elements and arrangement of parts which are adapted to effect such steps, all as exemplified in the following detailed description, and the scope of the invention will be indicated in the claims.

Briefly, in accordance with the present invention, the leading end of the web on a ready roll may be prepared in the usual way by tacking it to the underlying web convolution using adhesive tabs spaced along that end or using low tack adhesive spots or stripes applied to the underside of that web end. Also, a strip of double face adhesive tape or the equivalent is applied to the exposed surface of the leading edge margin of the web for adhering to the running web to make the splice.

To prevent the leading end of the web from being lifted due to windage when the ready roll is rotated, a special spoiler strip is adhered to the periphery of the ready roll just ahead of the leading end of the web on that roll. The spoiler strip has a longitudinal boundary line. A strip portion on one side of that bounder line further away from the web leading end is provided with a high tack adhesive undersurface; the strip portion on the opposite side of the strip boundary line nearer to the web end is adhesive free so that it forms a flap. The spoiler strip is positioned on the surface of the ready roll so that when the strip flap is folded down against the roll, the free longitudinal edge of the flap is adjacent to or just overlaps the leading end of the web on the ready roll.

When the ready roll is stationary, the flap portion of the spoiler strip may be folded somewhat away from the surface of the roll. However, when the roll is rotated in preparation for a splice, the strip encounters the on-coming air stream which exerts a force on the strip flap which folds the flap flat against the periphery of the roll so that the free edge of the flap abuts the web end. In this position, the strip deflects the air stream away from the leading end of the ready web. Resultantly, that air stream is unable to exert sufficient force on the leading end of the ready web to lift that end away from the underlying web convolution on the ready roll to which it is held by the adhesive tabs or low tack adhesive described above.

In some applications, when the ready roll is rotating at a very high speed or when a very low tack adhesive is being used to hold the leading end of the web to the ready web roll because of the fragility of the web material or for some other reason, it may be desirable to position the spoiler strip on the web roll so that the spoiler strip flap overlaps the leading end of the ready web to some degree. In this embodiment, then, the on-coming air stream pressing down on the edge margin of the strip flap actually helps to hold the leading end of the ready web against the web roll. Thus, there is no possibility of the web end being lifted prematurely from the web roll due to windage.

After the ready web roll has been accelerated to the speed of the running web and the running web is pressed against the periphery of the ready roll, the pasting of the two webs occurs as soon as the adhesive area on the leading end of the ready web is rotated through the splice nip. When this happens, the running web pulls the adhered leading end of the ready web away from the periphery of the ready roll without any appreciable interference from the spoiler strip. If that strip does overlap the leading edge of the ready web to any extent, it simply folds up out of the way as the ready web is pulled away from web roll by the running web.

As is the usual practice, after the paste has been made, a knife is actuated to sever the running web behind the splice to separate the running web from the expiring roll core so that the web on the ready roll now supplies the continuing needs of the web consuming machine. The spoiler strip remains firmly attached to the ready web so that it is drawn along with that web. The segment of web containing the spoiler strip can be excised at any convenient downstream location in the process line.

The spoiler strip described herein can be made of any suitable inexpensive flexible sheet material and it is easy to apply at the same time that the leading end of the ready web is being prepared in the usual way. Therefore, the cost of implementing the invention is not appreciably more than the cost of preparing the web conventionally.

BRIEF DESCRIPTION OF THE DRAWING

For a fuller understanding of the nature and objects of the invention, reference should be had to the following detailed description, taken in connection with accompanying drawing, in which.

DESCRIPTION OF PREFERRED EMBODIMENTS

Figure 1:
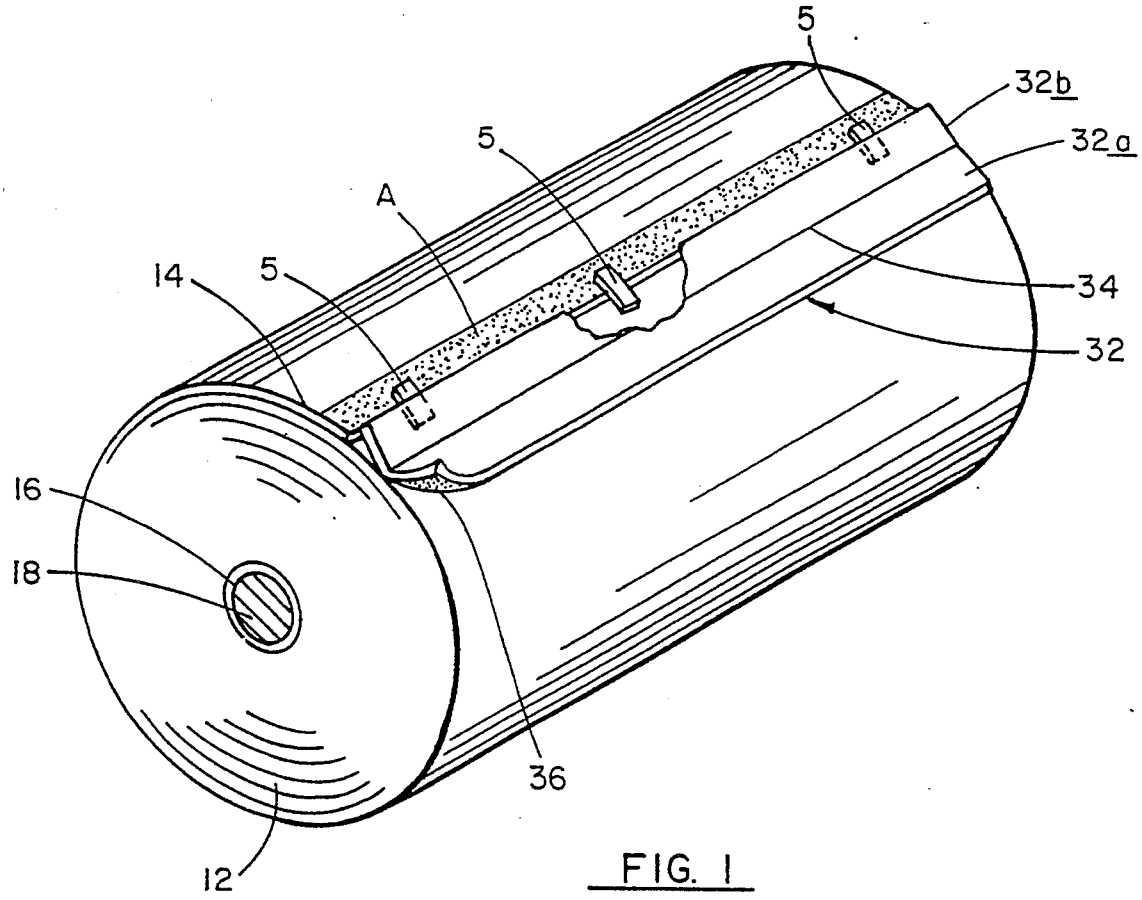
FIG. 1 is an isometric view of a ready web roll prepared with a spoiler strip in accordance with this invention.

Drawing FIG. 1 shows a roll 12 of web 14, e.g., paper, wound on a roll core 16 supported by a rotary shaft or spindle 18. The leading end 14*a* of web 14 has been prepared by squaring off that end using a straight edge and tacking that end to the periphery of roll 12 using short adhesive tabs T spaced along end 14*a*. In lieu of tabs T, the end 14*a* may be secured to the roll by applying a low tack adhesive to the undersurface of web 14 adjacent to end 14*a*. While the web end 14*a* is shown as being straight, it could just as well be some other shape as is well know in the art.

The normal preparation of the web 14 also involves the application of an adhesive area A to the exposed surface of the web 14 adjacent to and following the course of web end 14*a*. Thus on roll 12 in FIG. 1, an adhesive area A in the form of a stripe extends parallel to the straight web end 14*a*. The adhesive area may also be formed by double face adhesive tape or adhesive spots as is well known in the art.

Figure 2:
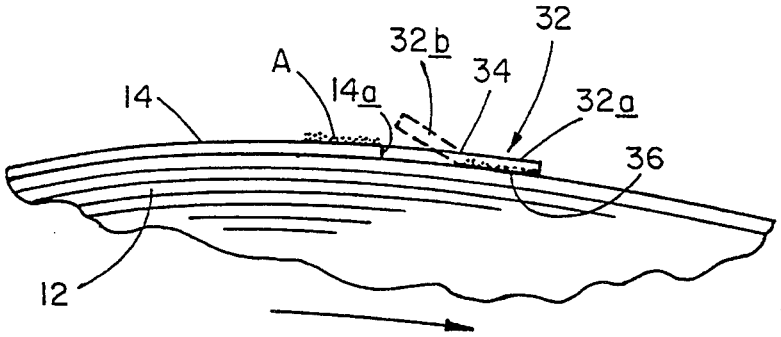
FIG. 2 is a fragmentary elevational view showing the spoiler strip in greater detail.

Referring to FIGS. 1 and 2, roll 12 is also prepared for splicing by applying to the periphery of the roll a special spoiler strip shown generally at 32. Spoiler strip 32 may be composed of paper, plastic or other appropriate thin flexible sheet material. For example, it may be similar to the backing material of conventional masking tape. It is different from masking tape, adhesive tape and other similar products in that it is divided longitudinally into two portions 32*a* and 32*b* by a longitudinal boundary line 34 which is preferably a fold line, and an adhesive coating 36 is applied to the underside of only one of those portions, i.e., portion 32*a* in FIG. 2. Typically, the strip 32 may be in the order of 1 inch wide, strip portions 32*a* and 32*b* being of substantially equal width.

Figure 3:
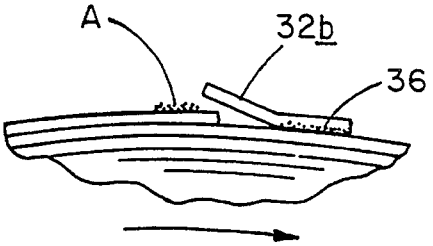
FIG. 3 is a similar view of another spoiler strip embodiment.

The spoiler strip 32 is applied to roll 12 by adhering the strip portion 32*a* to the periphery of the roll just ahead of the leading end 14*a* of the web on that roll so that the free longitudinal edge of strip portion 32*b* lies adjacent to or slightly overlaps the ready web end 14*a* when the portion 32*b* lies flat against the roll as shown in FIGS. 2 and 3. Preferably, the adhesive coating 36 consists of a high tack adhesive so that that strip 32 will not be lifted from the roll due to the force of the on-coming air stream when roll 12 is rotated clockwise in the direction of the arrow in FIG. 2. Also, during the preparation procedure, care should be taken so that the adhesive area A will not contact the flap portion 32*b* of strip 32 when that portion lies down against the surface of roll 12.

When roll 12 is stationary, the non-adhesive flap portion 32*b* of strip 32 may repose in an uplifted position shown in FIG. 1 and in FIG. 2 in phantom. However, when roll 12 is rotated in the direction of the arrow in FIG. 2, the on-coming air stream tends to push flap portion 32*b* down flat against the periphery of roll 12 to the solid line position shown in FIGS. 2 and 3. In that position, the flap portion 32*b* functions as a spoiler that tends to deflect the on-coming air away from the leading end 14*a* of the ready web. Thus, the air stream is unable to exert a force on the web end 14*a* that is sufficient to lift that end away from the underlying convolution of web 14 to which it is releasably adhered. Indeed, if the tab 32*b* overlaps web end 14*a* as depicted in FIG. 3, the force of the air stream acting on the free edge margin of strip portion 32*b* actually holds the web end 14*a* against the roll 12 no matter how fast the roll is rotated.

After roll 12 has been rotated to the splicing speed, the running web (not shown) may be pressed against the periphery of roll 12 as described for example in U.S. Pat. No. 4,948,060. Running web W will become adhered to the web 14 on the ready roll as soon as the adhesive area A is rotated into the nip of the two webs. When the paste occurs, the running web pulls the leading end of the ready web 14 away from its adhesive attachment to the underlying convolution of web 14 on roll 12. If the spoiler strip 32 is positioned so that its portion 32*b* butts against the leading end 14*a* of the ready web as depicted in FIG. 2, then the strip 32 does not interfere at all with the ready web as it is pulled away from roll 12 to follow the running-web. On the other hand, if strip 32 is positioned so that the free edge of portion 32*b* overlaps web end 14*a* to some extent as shown in FIG. 3, since the portion 32*b* is non-adherent, that portion simply folds up out of the way as the leading end of the ready web is pulled away from roll 12 by the running web. Therefore, in that case also, the strip 32 does not interfere with the paste of the two webs.

After the paste is made, the running web is severed just behind the splice between the two webs, e.g., behind the adhesive area A in FIG. 2, thereby separating the running web from its depleted roll core so that now the web 14 from roll 12 is drawn into the web consuming machine. The spoiler strip 32 remains adhered to web 14, typically being spaced about one roll circumference behind or upstream from the adhesive area A on the roll 12 in FIG. 2. Depending upon the nature of the downstream web consuming machine, that segment of web 14 containing strip 32 may be left un-used just as is the segment containing the adhesive area A, or it may excised from the web at some point as is well know in the art.

It will be apparent from the foregoing that the inclusion of the spoiler strip 32 in the splice preparation procedure for roll 12 does not add appreciably to the cost or time involved to complete that procedure. Furthermore, the strip itself costs no more than a length of conventional masking tape or adhesive tape. Therefore, the invention should find wide application wherever it is likely that a roll of ready web will be rotated at high speed to make a splice to a running web.

It will thus be seen that the objects set forth above, among those made apparent from the preceding description, are efficiently attained and, since certain changes may be made in carrying out the above method and in the constructions set forth without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention described herein.

I claim:

1. A device comprising:

a. a web on a roll Of web convolutions in preparation for a splice of said web end to another web, said web having a leading edge; and b. a spoiler strip having a thin flexible backing strip, means defining a lengthwise boundary line in the backing strip which extends the length of the backing strip, an adhesive coating on a surface portion of the backing strip on one side of said boundary line, the strip surface portion on the opposite side of said boundary line being non-adherent, said adhesive coating affixed to said roll just ahead of said leading edge.

2. The device defined in claim 1 wherein said adhesive coating is of a high tack adhesive.

3. The device defined in claim 1 wherein said boundary line is fold line.

4. The device defined in claim 1 wherein said backing strip is of a paper material.

5. The device defined in claim 1 wherein said non-adherent portion overlapping said leading edge.

6. A roll comprising:

a. a web wrapped in convolutions around a core, said web having a leading edge; and b. a spoiler strip having a thin flexible backing strip, means defining a lengthwise boundary line in the backing strip which extends the length of the backing strip, and an adhesive coating on a surface portion of the backing strip on one side of said boundary line, the strip surface portion on the opposite side of said boundary line being non-adherent such that said adhesive coating affixed to said roll just ahead of said leading edge.

7. The roll of claim 6 wherein said adhesive coating is of a high tack adhesive.

8. The roll of claim 6 wherein said boundary line is fold line.

9. The roll of claim 6 wherein said backing strip is of a paper material.

10. The roll of claim 6 wherein said non-adherent portion overlaps said leading edge.

* * * * *